US011812840B2

(12) United States Patent
Lecureuil et al.

(10) Patent No.: US 11,812,840 B2
(45) Date of Patent: Nov. 14, 2023

(54) CONTAINER FOR A COSMETIC PRODUCT AND REFILL FOR SUCH A CONTAINER

(71) Applicant: Albea Services, Gennevilliers (FR)

(72) Inventors: Frédéric Lecureuil, Gennevilliers (FR); Mark Edmondson, Gennevilliers (FR)

(73) Assignee: Albea Services, Gennevilliers (FR)

( * ) Notice: Subject to any disclaimer, the term of this patent is extended or adjusted under 35 U.S.C. 154(b) by 121 days.

(21) Appl. No.: 17/219,831

(22) Filed: Mar. 31, 2021

(65) Prior Publication Data

US 2021/0298454 A1 Sep. 30, 2021

(30) Foreign Application Priority Data

Mar. 31, 2020 (FR) ..... 2003229

(51) Int. Cl.

| | |
|---|---|
| ***A45D 40/16*** | (2006.01) |
| ***A45D 40/12*** | (2006.01) |
| ***A45D 40/02*** | (2006.01) |
| *A45D 40/00* | (2006.01) |

(52) U.S. Cl.

CPC ..... *A45D 40/16* (2013.01); *A45D 40/02* (2013.01); *A45D 40/12* (2013.01); *A45D 2040/0006* (2013.01); *A45D 2040/0043* (2013.01); *A45D 2040/0056* (2013.01)

(58) Field of Classification Search

CPC ..... A45D 40/02; A45D 40/04; A45D 40/12; A45D 40/16; A45D 2040/0043

See application file for complete search history.

(56) References Cited

U.S. PATENT DOCUMENTS

| | | | | |
|---|---|---|---|---|
| 4,505,607 | A * | 3/1985 | Sugiyama | A45D 40/06 401/98 |
| 2021/0068517 | A1* | 3/2021 | Trochel | A45D 40/06 |

FOREIGN PATENT DOCUMENTS

| | | |
|---|---|---|
| CN | 108523378 | 9/2018 |
| FR | 3074657 | 6/2019 |
| FR | 3084248 | 1/2020 |
| JP | H0548814 | 6/1993 |

* cited by examiner

*Primary Examiner* — Jennifer C Chiang

(74) *Attorney, Agent, or Firm* — Kilpatrick Townsend & Stockton LLP

(57) ABSTRACT

A refill intended to be removably mounted on an actuation base and configured to receive a cosmetic product includes at least one means for blocking in rotation designed to link in rotation the refill and the base and at least one recognition element, called first recognition element, arranged so as to form a predefined identification pattern configured to engage with a means for identifying the actuation base so as to enable the mounting of the refill on the actuation base and to allow an input and/or an output of the cosmetic product.

14 Claims, 13 Drawing Sheets

[Fig.1]
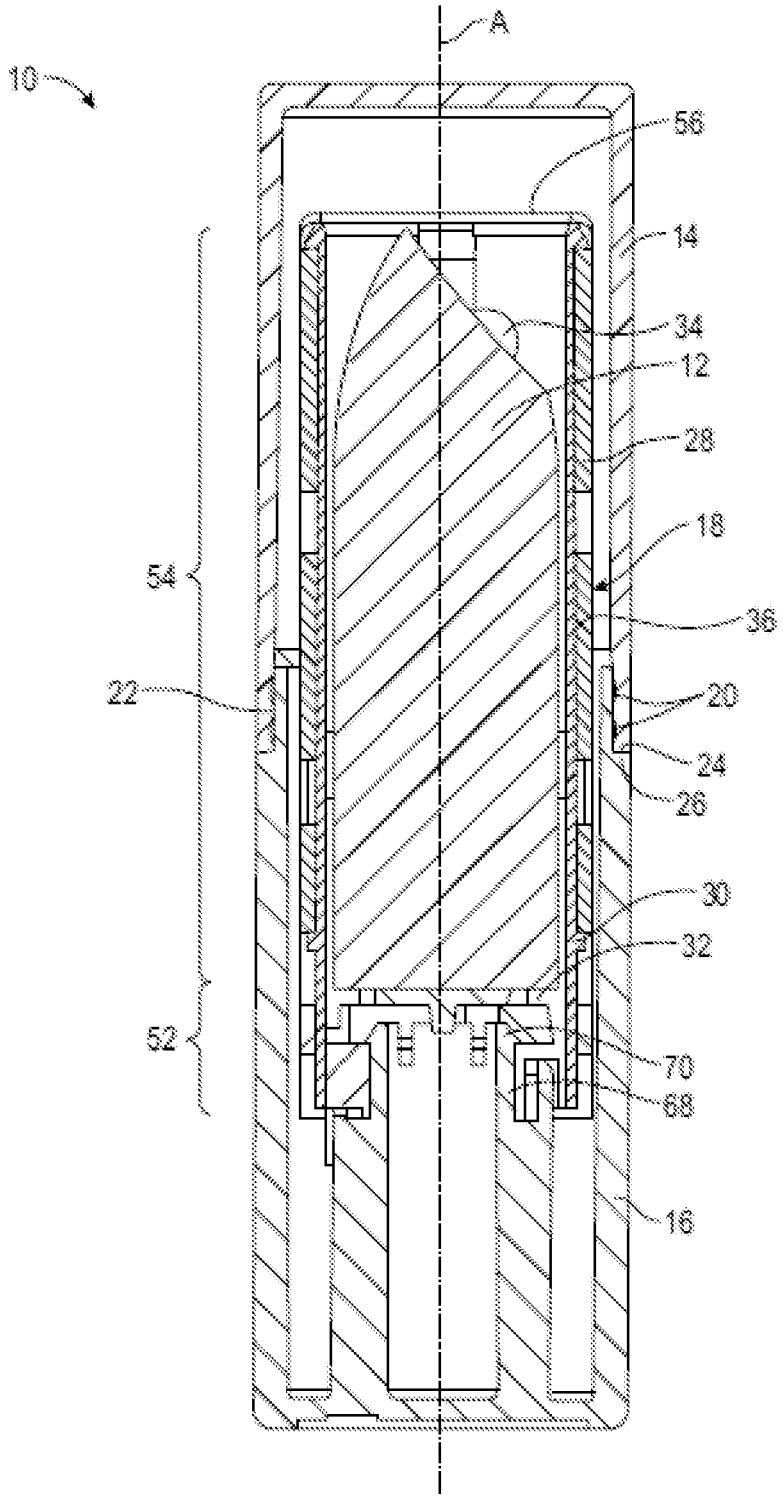

[Fig.2]
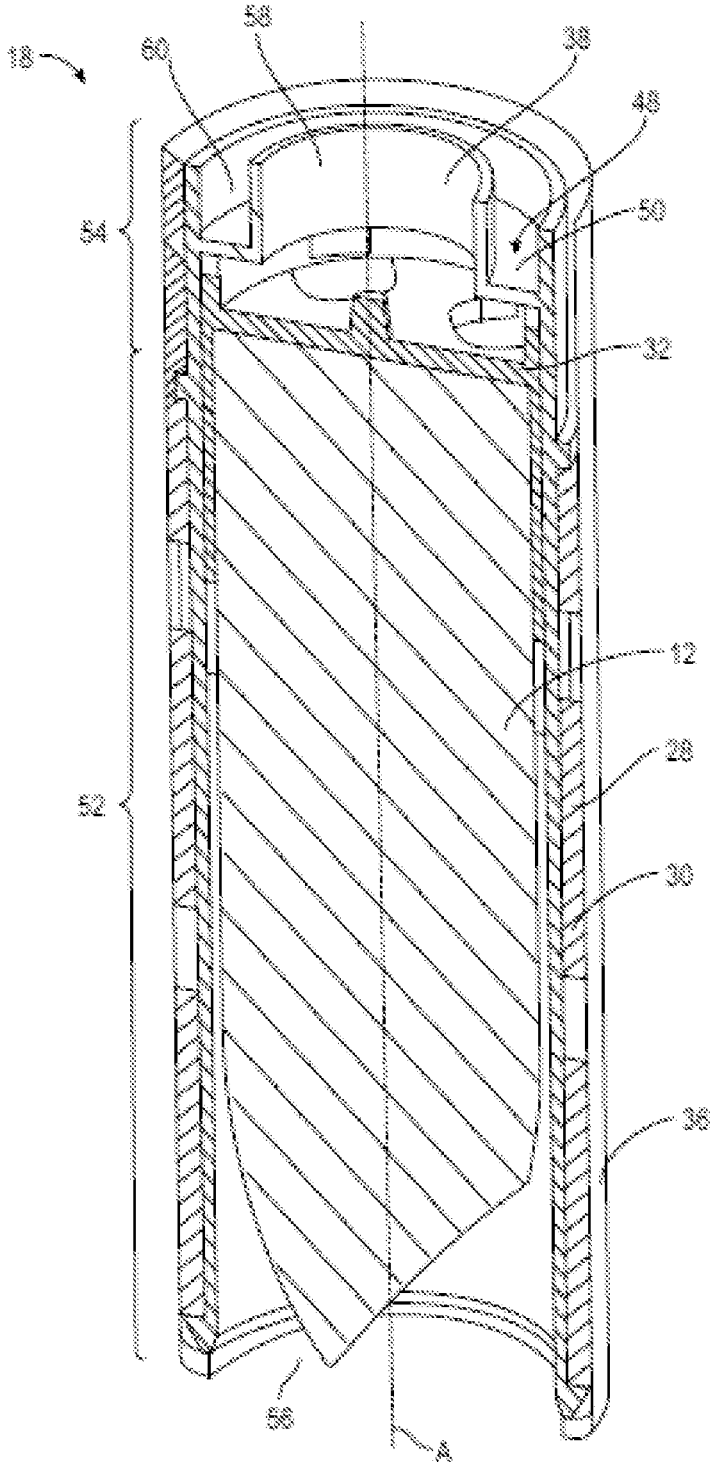

[Fig.3]
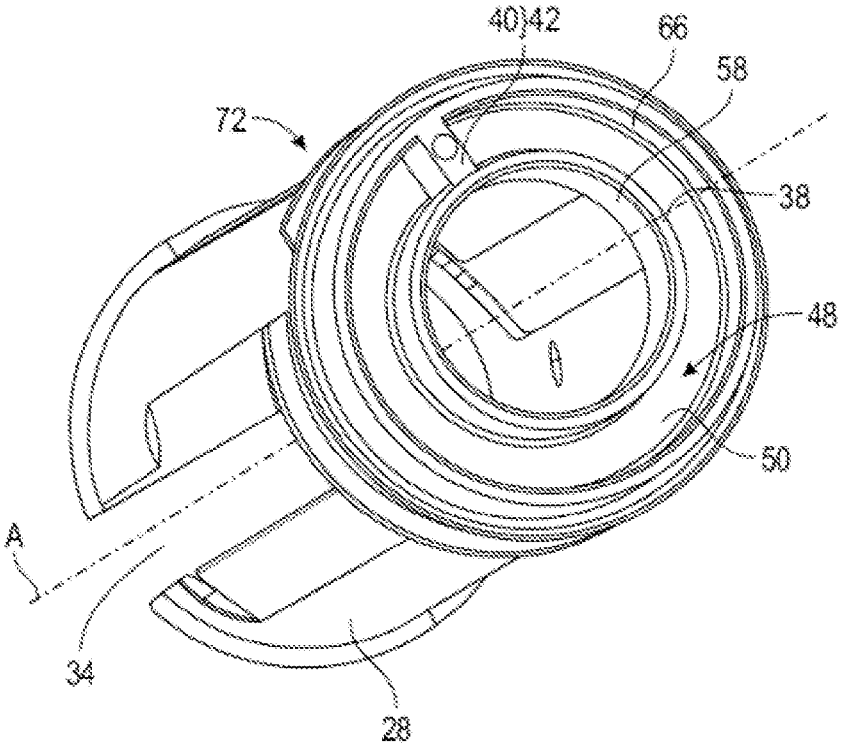
[Fig.4]
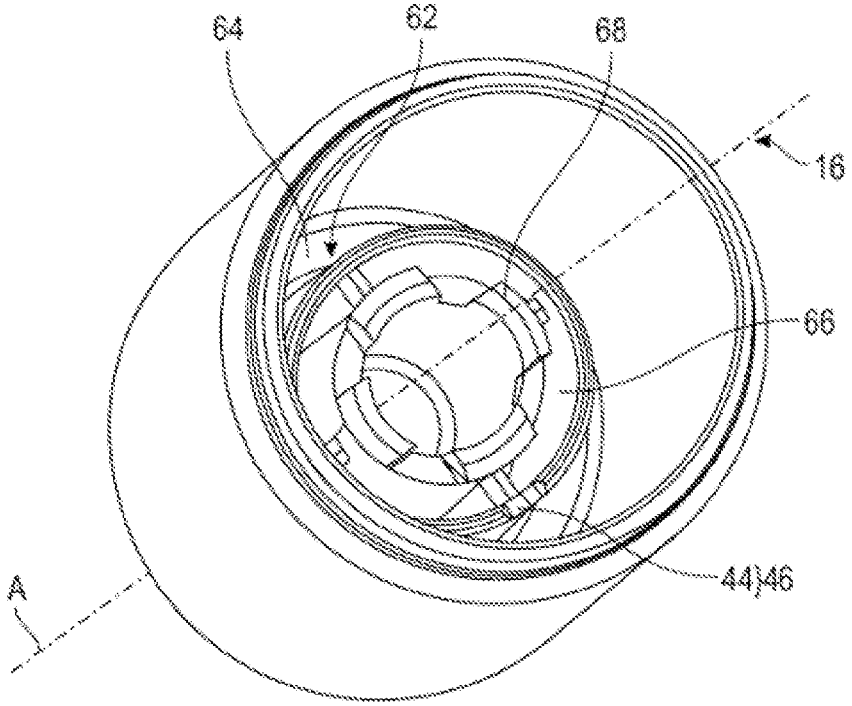

[Fig.5]
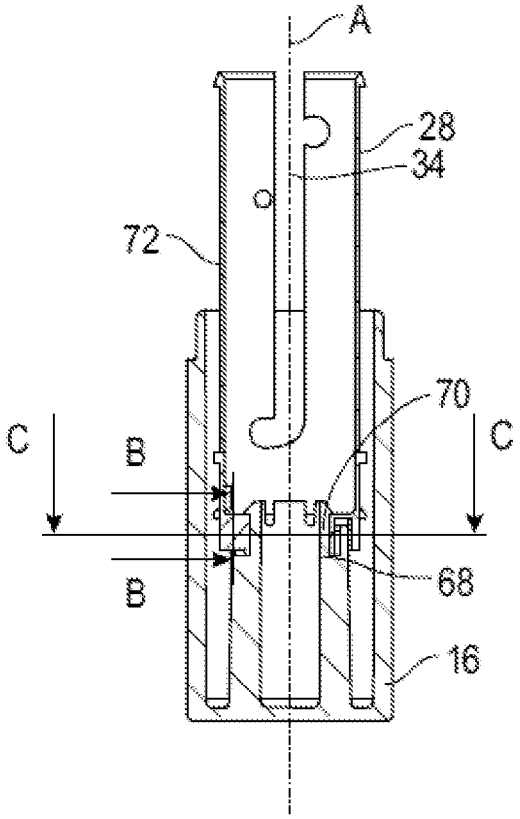
[Fig.6]
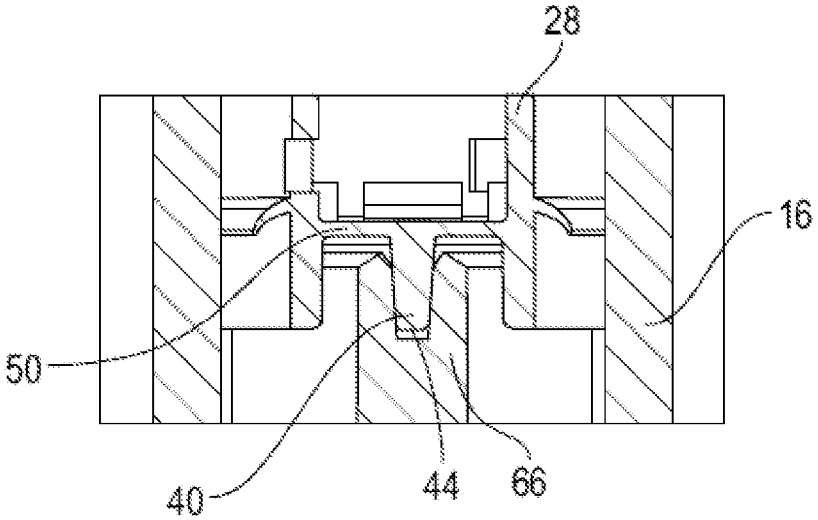

[Fig.7]
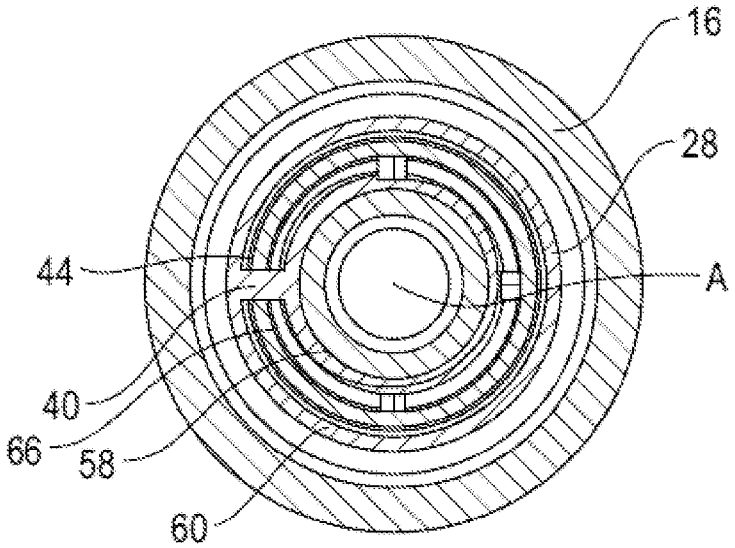
[Fig.8]
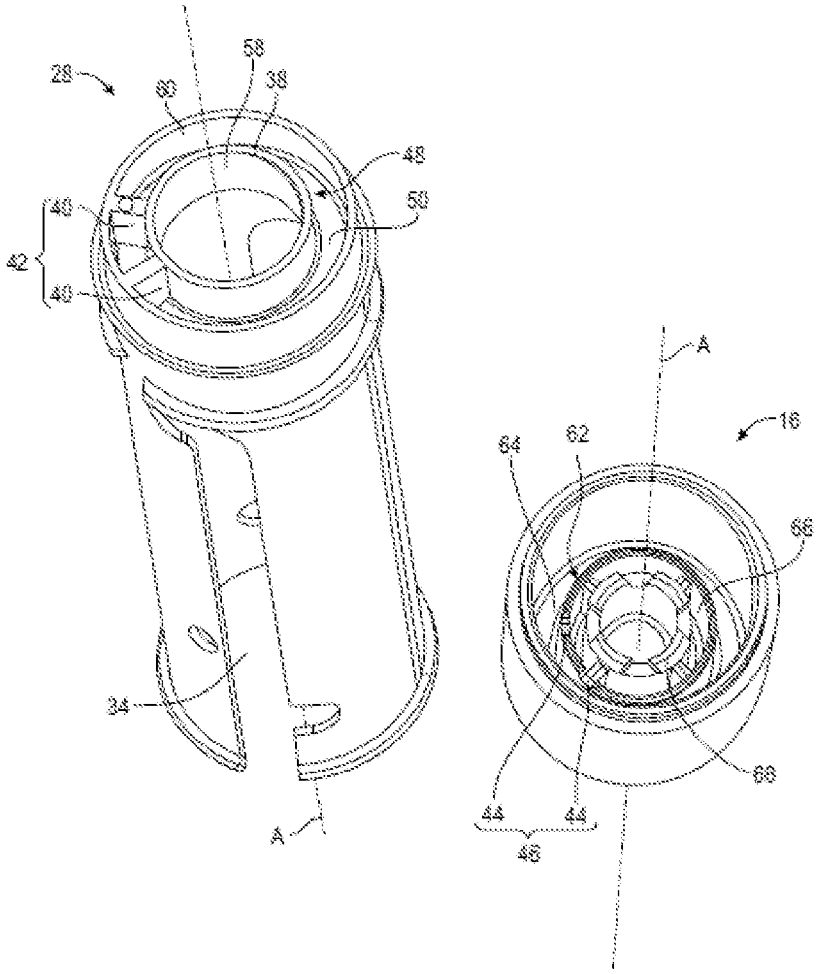

[Fig.9]
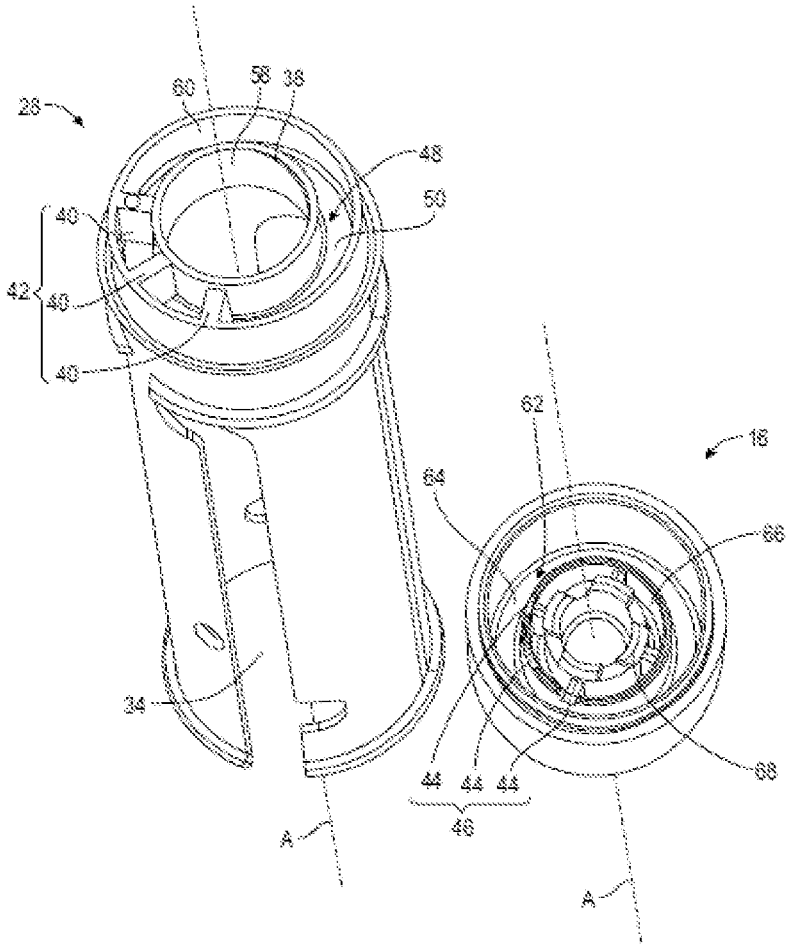

[Fig.10]
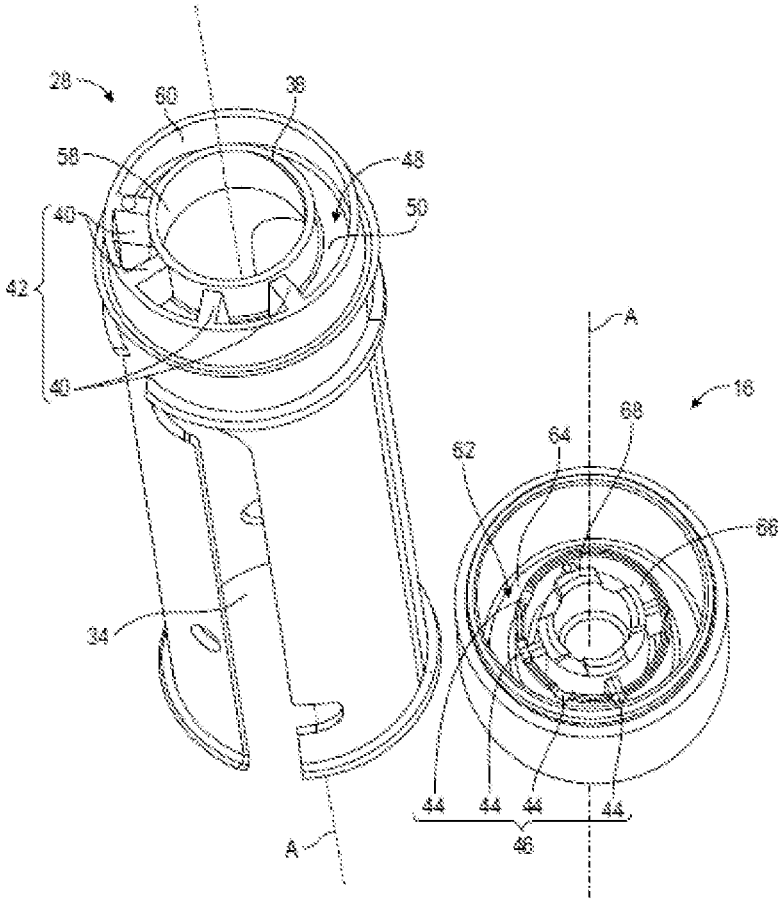

[Fig.11]
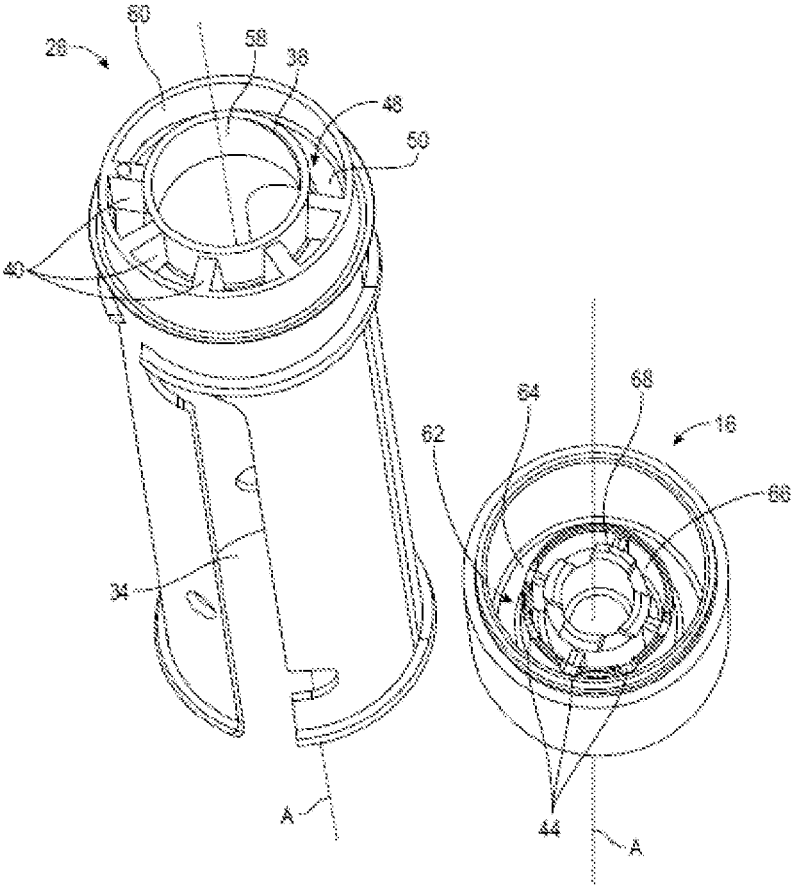

[Fig.12]
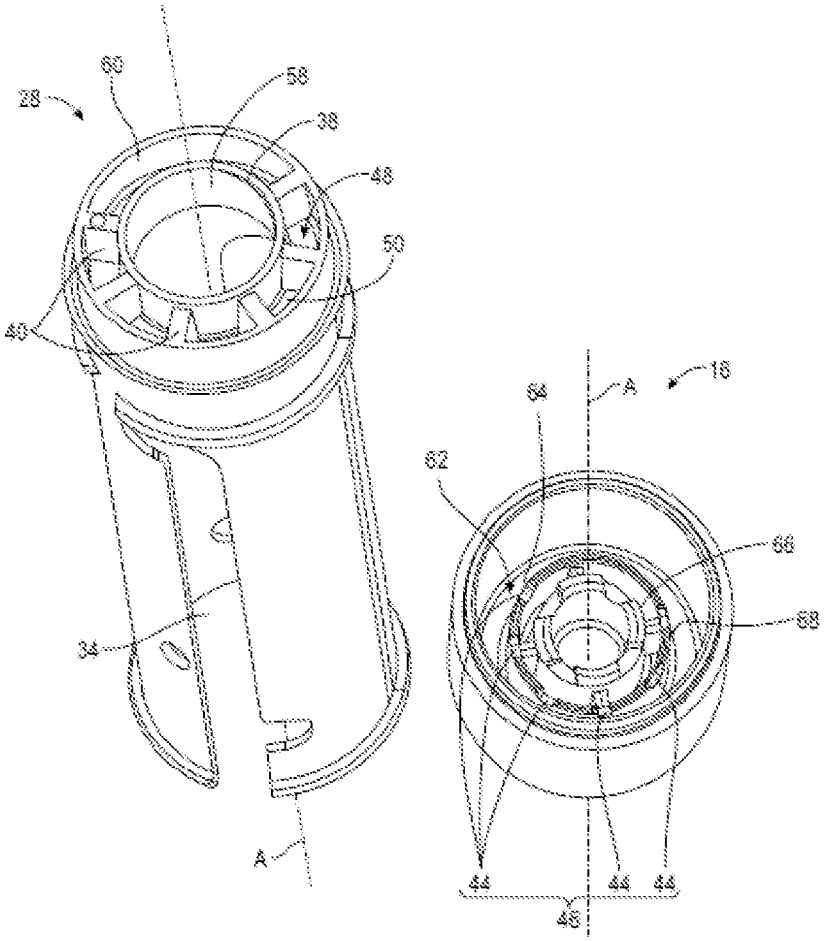

[Fig.13]
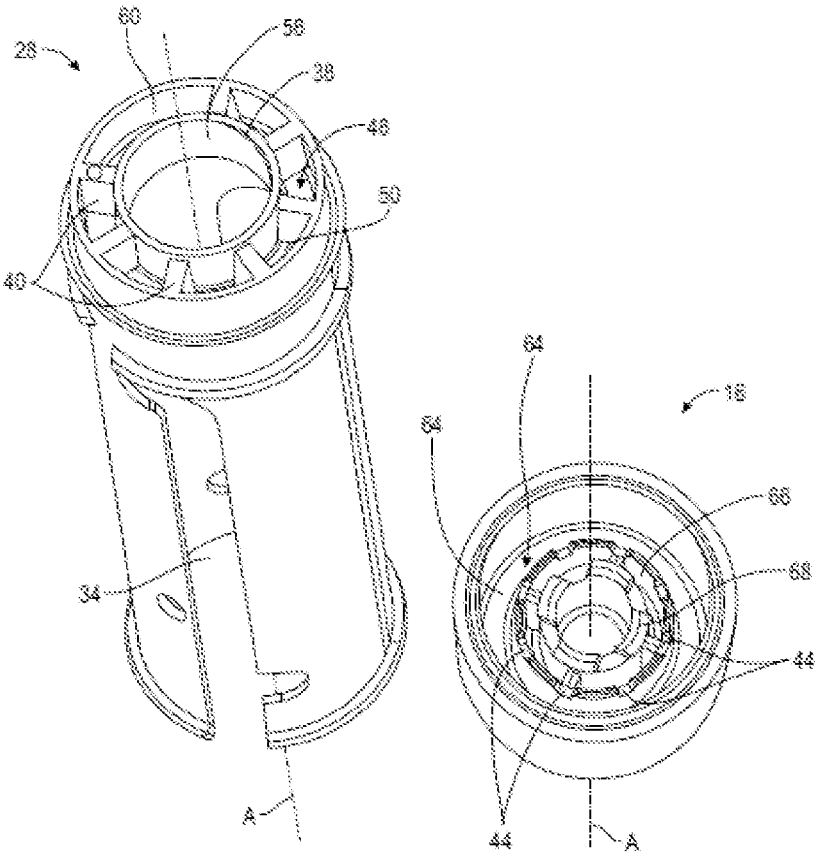

[Fig.14]
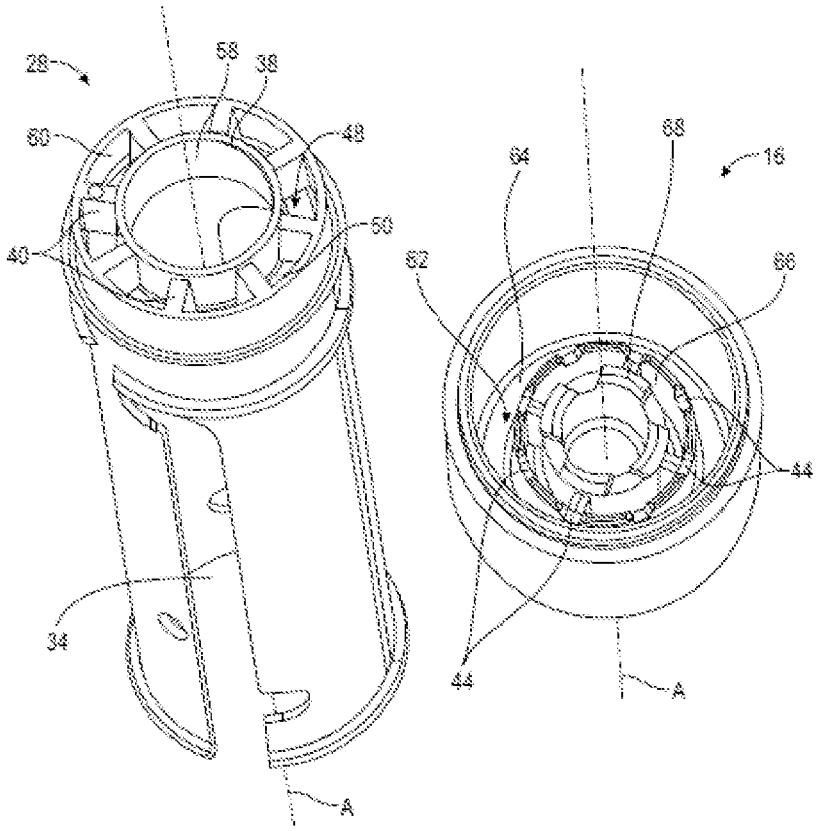

[Fig.15]
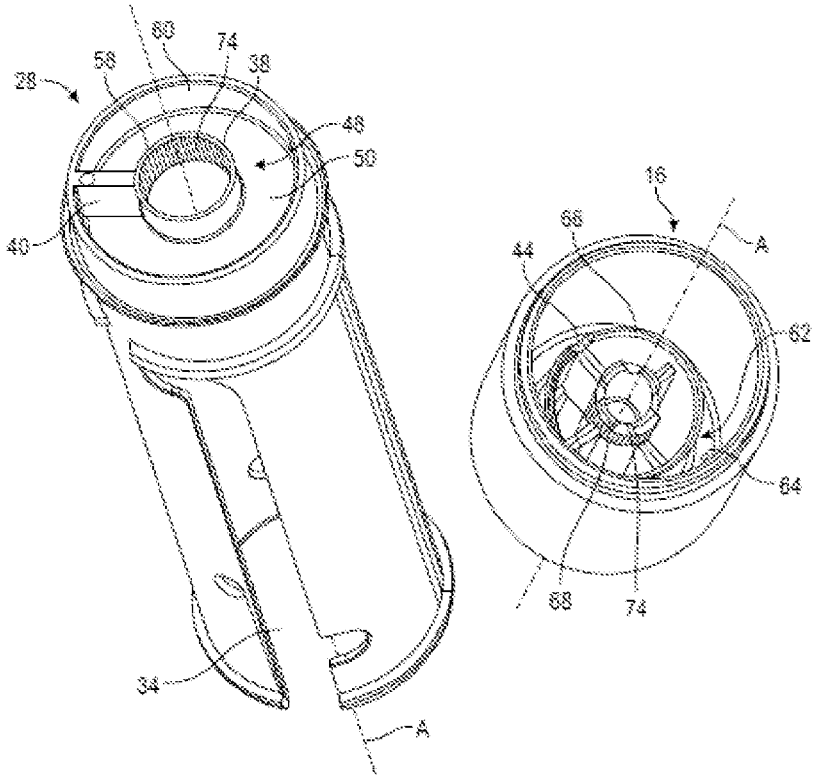

[Fig.16]
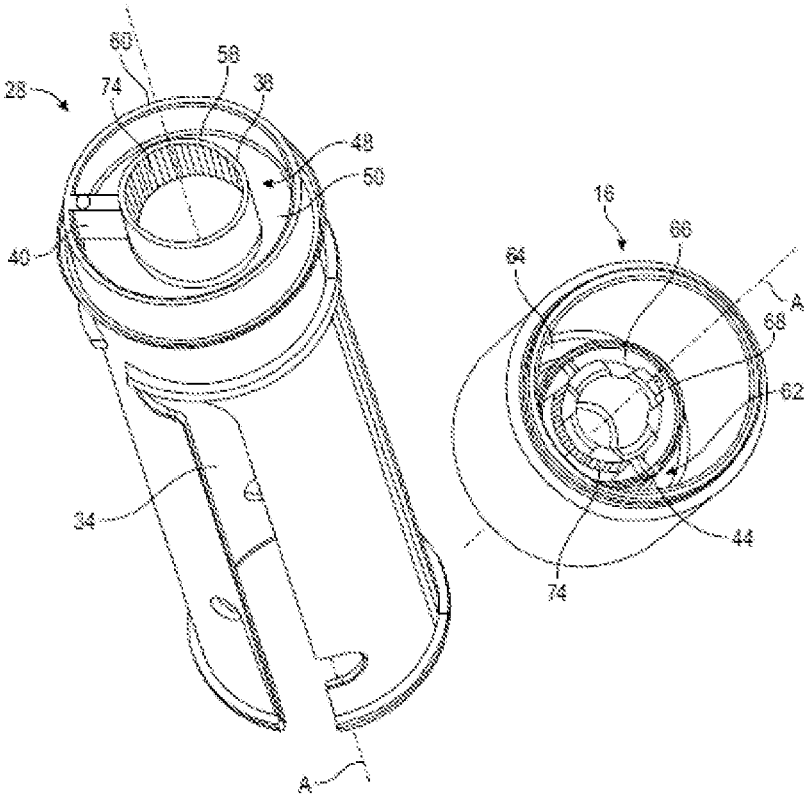

CONTAINER FOR A COSMETIC PRODUCT AND REFILL FOR SUCH A CONTAINER

CROSS REFERENCE TO RELATED APPLICATIONS

This application claims priority under 35 U.S.C. § 119(a) to French patent application 2003229 filed on Mar. 31, 2020, the entire teachings of which are incorporated herein by reference

BACKGROUND OF THE INVENTION

Field of the Invention

The invention relates to a refill intended to be removably mounted in a container for cosmetic product, in particular for a cosmetic product stick. The invention also relates to a container for a cosmetic product including at least one such refill.

Description of the Related Art

From the state of the art, examples of containers for a cosmetic product including a so-called "interchangeable" dispensing unit are known.

By comparison with a single-use container, such a container is characterized by the fact of being refillable, i.e. designed to allow a change of the dispensing unit, in particular but not exclusively after a complete use of the cosmetic product.

The interchangeability of the dispensing unit allows to also use, independently of a complete use, one same container with several dispensing units each including, for example, a different cosmetic product such as a lipstick of a given shade.

Such a design allows to conserve the cap and the base of the container which is particularly advantageous when these parts are made of precious and/or decorative materials, for example covered with a covering, which by comparison made of more expensive parts to be manufactured.

In addition, the cap and the base are outer parts visible from the container which determine its general appearance and consequently its originality.

In such a container, the interchangeable unit for dispensing the cosmetic product constitutes, in particular, a refill or cartridge which could be changed freely.

However, a user having a base cannot know which type of refill must be inserted in its container. Likewise, a user having a refill cannot know to which base it corresponds.

The insertion of an incorrect refill can lead to an incorrect functioning of the mechanism which can lead up to the deterioration of the mechanism of the base and/or of the refill.

There is therefore a need for a solution allowing to resolve at least some of the disadvantages of the prior art while conserving a unit which is interchangeable and advantageously simple and economical to manufacture.

BRIEF SUMMARY OF THE INVENTION

Thus, the invention relates to a refill having a main axis intended to be removably mounted on an actuation base and configured to receive a cosmetic product, the refill including at least two recognition elements, called first recognition elements, arranged so as to form a predefined identification pattern configured to engage with recognition elements, called second recognition elements, forming a complementary pattern for identifying the actuation base so as to enable the mounting of the refill on the actuation base to allow an input and/or an output of the cosmetic product, characterized in that the identification pattern is configured to be associated with the pattern for identifying the base according to one single angular position.

By "enable the mounting of the refill on the actuation base to enable an input and/or output of the cosmetic product", this means that this is a complete mounting and not of a partial association which could be sufficient to actuate the refill under non-nominal conditions, i.e. in particular without fixing the refill on the base. In other words, the input and/or output mechanism of the cosmetic product can only be activated if the refill is correctly associated in the base, this only being possible if the pattern for recognising the refill corresponds to the means for identifying the base. This allows, in particular, to avoid a deterioration of the input and/or output mechanism of the cosmetic product in the case of a refill not suitable for the base.

Moreover, the pattern for identifying the container allows a user to know to which base this corresponds (and vice versa) and wherein it can be inserted. There again, this allows to avoid to assemble the incorrect refill in the incorrect base at the risk of deteriorating the input and/or output mechanism of the cosmetic product. In other words, the pattern for identifying the refill allows to differentiate one same mechanism for different types of base, such that a mechanism can only be housed in a specific base having one single corresponding association configuration, which provides a simplification in the design of the mechanisms, while providing an industrial differentiation for different clients or brands. Also, in other words, the means for identifying the refill is configured to be indexed with a means for identifying the base so as to selectively enable the mounting of the refill on the base. It can be, for example, a specific angular positioning.

According to different embodiments of the invention, which can be taken together or separately:

the cosmetic product is a cosmetic product stick, the first recognition elements are angularly distributed in an annular zone about the main axis (A), the pattern for identifying the refill is further configured to engage with the means for identifying the base to ensure a blocking in rotation designed to link in rotation the refill and the base, the means for identifying the refill is configured such that the latter and the means for identifying the base are inserted in one another, at least one of the first recognition elements is a projection configured to engage with at least one cavity of the base, at least one of the first recognition elements is a cavity, configured to engage with at least one projection of the base, the projection of the refill is configured to extend radially on either side of the cavity of the base, the cavity of the refill is configured to be passed through radially on either side by the projection of the base, the refill has a first portion including a first end provided with an opening through which the cosmetic product exits, the refill has a second opposite portion inaccessible to the user when the refill is mounted on the actuation base, the second portion has an outer surface on which the identification pattern is arranged, the at least one projection is at least one ridge extending over the outer surface of the second portion, the at least one cavity is at least one notch extending over the outer surface of the second portion, the at least one first recognition element is a plurality of projections distributed over the outer surface of the second portion in a defined manner, the at least one first recognition element is a plurality of cavities distributed over the outer surface of the second portion in a defined manner, the at least one ridge extends radially over the outer surface of the second portion, the at least one notch extends radially over the outer surface of the second portion, the plurality of ridges is angularly distributed, the plurality of notches is angularly distributed, the plurality of ridges is distributed according to a random arrangement, the plurality of notches is distributed according to a random arrangement, the second portion is provided with a transversal bottom having an outer surface and/or a transversal wall extending from the transversal bottom in the direction of the first end and having an outer surface, the identification pattern is situated on the outer surface of the transversal bottom of the refill, the identification pattern is situated on the outer surface of the transversal wall, the transversal bottom of the refill further includes at least one skirt projecting from the outer surface of the transversal bottom, the transversal bottom of the refill includes an inner skirt and an outer skirt both forming the two projections, in particular longitudinally, from the outer surface of the transversal bottom, the or the skirts have dimensions defined according to the dimensions of the means for identifying the actuation base, the or the skirts have a circular transversal cross-section of defined diameter, the identification pattern extends between the inner skirt and the outer skirt, the outer skirt forms a continuous wall concealing the identification pattern, at least as a side view, the refill includes an actuation mechanism allowing the input and/or the output of the cosmetic product, the actuation mechanism is actuatable only when the refill is inserted on the actuation base, the refill includes an alternative or complementary means for blocking in rotation of the refill on the base, the means for blocking in rotation includes a set of grooves which extend axially, parallel to one another, the identification pattern is designed to axially link the refill with the base, the refill includes alternative or complementary fixing means which allow to axially link the base to the refill, the fixing means are formed by one or more different elements of the identification pattern, the fixing means are formed by the inner skirt, for example configured to engage with flexible tabs of the base, the identification pattern is personalised such that the refill is attributable to one single type of base, the identification pattern is configurable by a user.

The invention also relates to a collection of refills, each achieved according to the information of the invention, characterized in that at least two refills of the collection include a different identification pattern.

According to other features of the collection of refills:

each different identification pattern including a different number of first recognition elements, each different identification pattern has a different angular distribution of at least two first recognition elements, each different identification pattern includes at least one first recognition element of different sizes.

The invention also relates to a container for cosmetic product, including a refill such as described above and a corresponding actuation base allowing an input and/or an output of the cosmetic product stick, the refill being configured to be removably mounted on the actuation base.

According to the invention, the actuation base includes an identification means configured to engage with the means for identifying the refill when the refill is mounted on the actuation base so as to enable the mounting of the refill on the actuation base and to allow an input and/or an output of the cosmetic product.

According to different embodiments of the invention, which can be taken together or separately:

the container includes a cap, the means for identifying the actuation base includes at least one recognition element, called second recognition element, forming a complementary predefined identification pattern of the pattern for identifying the refill such that the means for identifying the refill corresponds to it, the at least one second recognition element is at least one cavity, the at least one second recognition element is at least one complementary projection of the at least one first recognition element, the at least one cavity is at least one notch engaging with the at least one ridge of the pattern for identifying the refill, the at least one projection is at least one ridge engaging with the at least one notch of the pattern for identifying the refill, the base includes at least one fixing means to axially link the actuation base with the refill, the length of the fixing means and a height of the at least one projection and/or a depth of the cavities are defined such that the at least one fixing means is only triggered if there is a shape engagement between the means for identifying the refill and the means for identifying the actuation base.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is an axial, cross-sectional view which represents a container after mounting a refill according to a first example of a first embodiment of the invention on an actuation base of the container;

FIG. 2 is an axial, cross-sectional view which represents the refill of FIG. 1;

FIG. 3 is a perspective, bottom view of a guide of the refill of FIG. 1;

FIG. 4 is a perspective, top view of the base of FIG. 1;

FIG. 5 is an axial, cross-sectional view which represents an assembly including the guide of FIG. 3 mounted on the base of FIG. 4;

FIG. 6 is a view in cross-section B-B of the assembly of FIG. 5;

FIG. 7 is a view in transversal cross-section C-C of the assembly of FIG. 5;

FIG. 8 is a perspective view of a guide and of a base according to a second example of the first embodiment of the invention;

FIG. 9 is a perspective view of a guide and of a base according to a third example of the first embodiment of the invention;

FIG. 10 is a perspective view of a guide and of a base according to the fourth example of the first embodiment of the invention;

FIG. 11 is a perspective view of a guide and of a base according to a fifth example of the first embodiment of the invention;

FIG. 12 is a perspective view of a guide and of a base according to a sixth example of the first embodiment of the invention;

FIG. 13 is a perspective view of a guide and of a base according to a seventh example of the first embodiment of the invention;

FIG. 14 is a perspective view of a guide and of a base according to an eighth example of the first embodiment of the invention;

FIG. 15 is a perspective view of a guide and of a base according to a first example of a second embodiment of the invention;

FIG. 16 is a perspective view of a guide and of a base according to a second example of a second embodiment of the invention.

DETAILED DESCRIPTION OF THE INVENTION

By convention, the "axial" direction corresponds to the of main extension of the container, illustrated by the axis A in the figures and the "radial" direction is orthogonal to the axial direction.

In the following detailed description of the figures, the terms "upper" and "lower" or also "top" and "bottom" will be used in a non-limiting manner in reference to the axial direction.

In the same manner, the terms "outer or external" and "inner or internal" are used in reference to the radial direction, an outer element being radially farther away from the axis A than an inner element.

Below in the description, elements having an identical structure or similar functions will be designated by the same references.

In FIG. 1, an example of an embodiment of a container 10 has been represented, also called case, of a cosmetic product.

In the example of the embodiment, the cosmetic product is a cosmetic product stick 12 and, more specifically, the cosmetic product stick 12 is a lipstick 12 intended to be applied by friction, in a variant a lip balm.

The container 10 includes at least one cap 14 which is associated with an actuation base 16 having a complementary shape, the base 16 and the cap 14 together defining an outer edge of the container 10.

The container 10 further includes a refill 18 for the distribution of the cosmetic product stick 12.

In a non-limiting manner, the cap 14, the base 16 of the container 10 and the refill 18 have a cylindrical shape of circular cross-section.

Preferably, the cap 14 is removable. The cap 14 is likely to occupy at least one opening position wherein the cap 14 is separated from the base 16 in view, in particular, of allowing the application of the cosmetic product and a closing position wherein the cap 14 is integral with the base 16 (FIG. 1).

The lower portion of the cap 14 includes inside two annular protrusions 20 which are intended to engage with an outer cylindrical surface of the base 16 including a complementary protrusion 22.

Advantageously, the annular protrusions 20 ensure the holding of the cap 14 in closing position and contributes to the obtaining of an airtight closing in order to guarantee a good conservation of the cosmetic product stick 12, in use of the refill 18.

The cap 14 includes a lower edge 24 which is likely to abut against a shoulder 26 which extends radially at the level of the connection of the upper portion of the base 16 with a lower portion of a greater diameter, when it is in closing position.

An example of an embodiment of the refill 18 is illustrated in FIG. 2.

The refill 18 has a main axis which extends along the axial direction, combined with the main axis A of the container 10.

The refill 18 is intended to be removably mounted on an actuation base, for example the base 16 of the container 10 for cosmetic product described above.

The refill 18 is intended to be able to be changed, in particular but not exclusively after the complete use of the cosmetic product stick 12.

The refill 18 and its input and/or output mechanism of the cosmetic product stick 12 below are only given as a non-limiting example.

In the example of the embodiment, the refill 18 includes a guide 28 of which the rotating with respect to a sheath 30 causes an axial movement of a cup 32 carrying the cosmetic product stick 12.

The guide 28, the sheath 30 and the cup 32 form a mechanism for actuating the refill 18 allowing an input and/or an output of the cosmetic product stick 12.

The cup 32 includes at least one lug (non-visible), preferably two diametrically opposite lugs.

The lugs engage respectively with slides 34 of the guide 28, the slides 34 extending axially rectilinearly. Each slide 34 advantageously includes, at each of its upper and lower ends, an angular indentation forming end position abutment for the lugs of the cup 32.

The sheath 30 surrounds the guide 28. The sheath 30 internally includes two helical grooves (non-visible) with which engage respectively the free end of the lugs, each lug radially passing through the associated slide of the guide 28 to be engaged in a groove.

The refill 18 also includes here an envelope 36, also called sleeve or liner, which is mounted by force or glued to the outside of the sheath 30, and integral in rotation with the sheath 30.

The guide 28 includes a roller 38. The roller 38 is situated axially to the lower end of the guide 28.

The roller 38 is intended to allow the rotating of the guide 28 causing, along the direction of rotation, an axial ascending or descending movement of the cup 32 and this forming the cosmetic product stick 12.

Preferably, the roller 38 is integrally made of one single part, with the guide 28 and the refill 18. In a variant, the roller 38 is a separate part fixedly applied on the guide 28.

In such a container 10, the roller 38 of the refill 18 is actuated, after having previously removed the cap 14, by way of the base 16.

Consequently, the roller 38 and the base 16 must, on the one hand, be connected axially together and, on the other hand, be linked in rotation to ensure the transmission to the roller of the refill 18 of any rotation movement applied to the base 16.

For this, the refill 18 must be correctly inserted in the correct base 16.

This is particularly the case, for refills 18, as those represented in the embodiments illustrated here, for which the actuation mechanism is actuatable only when the refill 18 is inserted on the corresponding actuation base 16.

Thus, according to the invention, the refill 18 includes at least two recognition elements, called first recognition elements 40, arranged so as to form a predefined identification pattern 42 configured to engage with a means for identifying the actuation base 16 so as to enable the mounting of the refill 18 on the actuation base 16 to allow an input and/or an output of the cosmetic product, the identification means 42 being configured to be associated with the pattern for identifying the base 16 according to one single configuration, in particular according to one single angular position. In other words, thanks to this single association method achieved by the pattern for identifying 42 the refill and the corresponding identification means of the base 16, only the suitable base 16 can engage with the refill 18 to allow an operational mounting on top of one another.

Advantageously, the means for identifying the actuation base 16 includes at least two recognition elements, called second recognition elements 44, forming a complementary predefined pattern 46 of the pattern for identifying 42 the refill 18 such that the pattern for identifying 42 the refill 18 corresponds to it.

The pattern for identifying 42 the refill 18 can thus be personalised such that the refill 18 is attributable to one single type of base 16. Moreover, the pattern for identifying 42 the refill can be configurable by a user. For example, a user, such as a refill retailer 18, can choose to activate a particular pattern from a preformed pattern.

In the two embodiments represented in FIGS. 1 to 14 and 15 to 16, the pattern for identifying 42 the refill 18 is situated on an outer surface 48 of a transversal bottom 50 of the guide 28, i.e. the transversal bottom of the refill 18.

The refill 18, here the guide 28 on which the identification pattern 42 is situated, and the base 16 thus form a complementary identification system.

The pattern for identifying 42 the refill 18 is situated at the level of a portion of the refill 18, called second portion 52, opposite a first portion 54 including a first end provided with an opening 56 through which the cosmetic product exits.

This second portion 52 is inaccessible to the user when the refill 18 is mounted on the actuation base 16.

In this first embodiment, the transversal bottom 50 of the guide 28 includes an inner skirt 58 and an outer skirt 60 both projecting longitudinally from the outer surface 48 from the bottom 50 to the bottom in the direction of the outside of the guide 28.

The inner skirt 58 and the outer skirt 60 are concentric and they are centred on the main axis A of the refill 18. The inner skirt 58 and the outer skirt 60 delimit an annular zone about the main axis A.

In the example illustrated, the inner skirt 58 serves as a roller 38 such as described above.

Preferably, the outer skirt 60 forms a continuous wall concealing the identification pattern 42, at least as a side view.

Advantageously, in this first embodiment, the pattern for identifying 42 the refill 18 is composed of at least one projection in the form of a ridge 40 corresponding to at least one of the first elements for recognising 40 the refill 18 extending in particular radially, in the delimited annular zone between the inner skirt 58 and the outer skirt 60 of the guide 28.

The complementary identification pattern 46 of the base 16 is situated on an inner surface 62 of a transversal bottom 64 of the base 16.

The base 16 includes a skirt 66 provided with cavities in the form of notches 44 corresponding to the second elements for recognising 44 the pattern for identifying 46 the base 16.

The notches 44 of the base 16 are configured to receive the ridges 40 of the refill 18 which are inserted inside these as is visible in FIGS. 6 and 7. The refill 18 cannot be correctly inserted in the base 16, only if the number, the size, the distribution of the notches 44 of the base 16 and ridges 40 of the refill 18 correspond.

In this first embodiment, the notches/ridges system 44, 40 allows a blocking in rotation of the refill 18 with respect to the base 16 so as to link the base 16 and the container 10 in rotation.

It must be noted that, conversely, the ridge(s) can be on the base 16 and the notch(es) on the refill 18. Generally, by notch, this means any type of indentation, groove and/or slot which could engage with the corresponding ridge.

Preferably, the ridges and the notches, even if some of them penetrate inside the others, have different configurations and/or dimensions. For example, the ridges extend radially and the notches extend angularly such that some of them do not mesh necessarily on the others, contrary to parallel grooves such as mentioned below in relation to the rotating of the embodiment of FIG. 15.

Advantageously, the projection of the refill 18 is configured to extend radially on either side of the cavity of the base 16 and/or the cavity of the refill 18 is configured to be radially passed through on either side by the projection of the base 16. This is in particular obtained thanks to the insertion configuration chosen. According to this, preferably, a distal edge of the ridge comes opposite a bottom of the notch.

Moreover, in this embodiment, the base 16 includes four tabs 68 serving as fixing means which allow to axially link the actuation base 16 to the refill 18, here to the guide 28.

The four tabs 68 of the actuation base 16 are angularly distributed regularly, that is at 90°. The tabs 68 are inserted in a complementary orifice arranged centrally and defined by the inner skirt 58 of the refill 18. Advantageously the tabs 68 are flexible.

The free end of each tab 68 is configured to form a hook 70 which engages with an upper edge of the orifice of the roller 38 in order to block axially the actuation base 16.

Advantageously, the tabs 68 are configured such that they are snap-fitted with the refill 18 only if the pattern for recognising the refill 18 corresponds to the pattern for recognising the base 16.

Preferably, the length of the fixing means, here tabs 68 and a height of the ridges 40 are defined such that the fixing means is only snap-fitted if there is an engagement of shape between the pattern for identifying 42 the refill 18 and the pattern for identifying the actuation base 16. The distal edge of the ridge(s) is thus closely opposite, even abutting the bottom of the notch(es).

Eight different examples of embodiments of the first embodiment, forming a collection of refills 18 including different identification patterns 42, are represented here. These examples differ by the number of first and second recognition elements 40, 44 composing the patterns for identifying 42, 46 the refill 18 and the base 16. In these examples, the pattern for identifying 42 the refill 18 is composed of one to eight ridges 40 and the pattern for identifying 46 the base 16 is composed of one to eight notches 44.

FIGS. 1 to 7 illustrate an example of an embodiment, wherein the refill 18 includes a ridge 40 and the base 16 includes a notch 44.

FIG. 8 illustrates an example of an embodiment, wherein the refill 18 includes two ridges 40 and the base 16 includes two notches 44.

FIG. 9 illustrates an example of an embodiment, wherein the refill 18 includes three ridges 40 and the base 16 includes three notches 44.

FIG. 10 illustrates an example of an embodiment, wherein the refill 18 includes four ridges 40 and the base 16 includes four notches 44.

FIG. 11 illustrates an example of an embodiment, wherein the refill 18 includes five ridges 40 and the base 16 includes five notches 44.

FIG. 12 illustrates an example of an embodiment, wherein the refill 18 includes six ridges 40 and the base 16 includes six notches 44.

FIG. 13 illustrates an example of an embodiment, wherein the refill 18 includes seven ridges 40 and the base 16 includes seven notches 44.

FIG. 14 illustrates an example of an embodiment, wherein the refill 18 includes eight ridges 40 and the base 16 includes eight notches 44.

In the example of the embodiment of FIG. 14 including eight notches/ridges 44, 40, the ridges 40 of the refill 18, and consequently the notches 44 of the base 16, are angularly distributed irregularly.

According to the invention, all the possible distributions of the recognition elements can be considered as long as they ensure a combined unicity, i.e. an assembly in one single position of the refill with the associated base.

According to these different embodiments, it is observed that the refill has, thanks to the or the ridges, a visual signature, similar to a cylinder.

In another embodiment, not represented, the pattern for identifying 42 the refill 18 can be situated on an outer surface of a transversal wall 72 of the refill 18, for example, of the guide 28, which extends from the transversal bottom 50 in the direction of the first end. In this case, the identification pattern is also arranged in an annular zone delimited radially inwards through the transversal wall 72.

The complementary identification pattern 46 of the base 16 is thus situated on an inner surface of a transversal wall of the base 16 which extends from the transversal bottom 64 of the base 16 to the top of the base 16 which has an opening through which is inserted the refill 18.

In the second embodiment represented in FIGS. 15 and 16, the system of patterns for identifying 42, 46 the container 10 and the base 16 is similar to that of the first embodiment.

However, in this second embodiment, the inner skirt 58 projecting from the outer surface 48 of the transversal bottom of the refill 18, here from the transversal bottom 50 of the guide 28, can have variable dimensions from one refill 18 to the other, in particular defined according to the dimensions of the pattern for identifying 46 the actuation base 16.

The inner skirt 58 of the refill 18 here has a circular transversal cross-section of defined diameter. Thus, as illustrated in the different examples, the inner skirt 58 of the refill 18 has a different diameter from one example to the other.

In this embodiment, the diameter of the inner skirt 58 is defined according to the diameter of a skirt of the base 16 formed by the tabs 68 serving as fixing means like in the first embodiment, such that the tabs 68 are inserted inside the inner skirt 58 of the refill 18 which defines a complementary orifice arranged centrally. In other words, the tabs 68 form a skirt of outer diameter less than the inner diameter of the inner skirt 58 of the container 10.

Similarly to the refill 18, for the base 16, the skirt formed by the tabs 68 have a different diameter from one example to the other.

The inner skirt 58 of the example of FIG. 15 having a diameter less than the diameter of the inner skirt 58 of the example of FIG. 16 and the skirt formed by tabs 68 of the example of FIG. 15 having a diameter less than the diameter of the skirt formed by the tabs 68 of the example of FIG. 16.

As is represented in the second embodiment illustrated in FIGS. 15 and 16, the refill 18 and the base 16 can include, optionally, at least one means for blocking in rotation designed to link in rotation the refill 18 and the base 16.

In this second embodiment, the blocking in rotation is also achieved by a complementary notching of the refill 18 (here of the guide 28) and of the base 16.

It can be, for example, a means for meshing the container 10, for example the guide 28, intended to engage with a complementary means of the base 16.

In this second embodiment, the at least one means for blocking in rotation is a set of grooves 74 which extend axially, parallel to one another over the inner surface of the inner skirt 58 of the container 10 and over the outer surface of the skirt formed by the tabs 68 of the base 16.

In a variant of an embodiment, the envelope 36 and/or the sheath 30 are extended axially beyond the roller 38, this in order to prevent or at the very least make access to the roller 38 difficult. Such a configuration allows to limit the actuation of the refill by a user even before the refill has been associated with the corresponding base.

According to the different embodiments mentioned and advantageously, the or the identification means and the or the identification means are made of material of the adjacent part, for example of the roller 38 and/or of the base 160*f* note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A refill having a main axis intended to be removably mounted on an actuation base and configured to receive a cosmetic product, said refill comprising at least two recognition elements, called first recognition elements, arranged so as to form a predefined identification pattern configured to engage with recognition elements called second recognition elements, forming a complementary pattern for identifying the actuation base so as to enable mounting of the refill on the actuation base to allow an input and/or an output of the cosmetic product, wherein said identification pattern is configured to be associated with said pattern for identifying the actuation base according to one single angular position;

wherein the first recognition elements are distributed angularly in an annular zone about the main axis.

2. The refill according to claim 1, wherein said pattern for identifying the refill is further configured to engage with said pattern for identifying the actuation base to ensure a blocking in rotation designed to link in rotation the refill and the actuation base.

3. The refill according to claim 1, wherein said pattern for identifying the refill is configured such that the refill and said pattern for identifying the actuation base are inserted in one another.

4. The refill according to claim 1, wherein at least one of the first recognition elements is a projection configured to engage with at least one cavity of the actuation base.

5. The refill according to claim 4, wherein at least one of the first recognition elements is a cavity configured to engage with at least one projection of the actuation base.

6. The refill according to claim 1, further comprising: a first portion comprising a first end provided with an opening through which the cosmetic product exits; and a second opposite portion inaccessible to a user when the refill is mounted on the actuation base, the second portion having an outer surface on which the identification pattern is arranged.

7. The refill according to claim 5, wherein said at least one projection of the refill is configured to extend radially on either side of the cavity of the actuation base and/or the cavity of the refill is configured to be passed through radially on either side by the projection of the actuation base.

8. The refill according to claim 6, wherein the second portion comprises at least one ridge extending over the outer surface of the second portion, and at least one notch extending over the outer surface of the second portion.

9. The refill according to claim 8, wherein the at least one of the first recognition elements is a plurality of projections and/or cavities distributed over the outer surface of the second portion in a defined manner.

10. The refill according to claim 8, wherein the second portion is provided with a transversal bottom having an outer surface, the identification pattern being situated on the outer surface of the transversal bottom of the refill, the transversal bottom of the refill further comprising at least one skirt projecting from the outer surface of the transversal bottom, said skirt having defined dimensions according to dimensions of the pattern for identifying the actuation base.

11. The refill according to claim 10, wherein the transversal bottom of the refill comprises an inner skirt and an outer skirt both projecting longitudinally from the outer surface of the bottom, said identification pattern extending between said inner skirt and said outer skirt.

12. The refill according to claim 1, comprising fixing means which allow to axially link the actuation base to the refill, said fixing means being formed by one or more different elements of said identification pattern.

13. A container for cosmetic product, comprising:

a refill having a main axis intended to be removably mounted on an actuation base and configured to receive a cosmetic product, said refill comprising at least two recognition elements, called first recognition elements, arranged so as to form a predefined identification pattern configured to engage with recognition elements called second recognition elements, forming a complementary pattern for identifying the actuation base so as to enable mounting of the refill on the actuation base to allow an input and/or an output of the cosmetic product, wherein said identification pattern is configured to be associated with said pattern for identifying the actuation base according to one single angular position; and a corresponding actuation base allowing an input and/or an output of the cosmetic product, said refill being configured to be removably mounted on the actuation base, said actuation base comprising means for identifying the actuation base configured to engage with the pattern for identifying the refill when the refill is mounted on the actuation base so as to enable mounting of the refill on the actuation base and to allow an input and/or an output of the cosmetic product;

wherein the first recognition elements are distributed angularly in an annular zone about the main axis.

14. The container according to claim 13, wherein the means for identifying the actuation base comprises at least one recognition element, called second recognition element, forming a predefined pattern for identifying complementary to the pattern for identifying the refill such that the pattern for identifying the refill corresponds to it, and wherein the at least one second recognition element is at least one cavity and/or at least one complementary projection of the at least one of the first recognition element.

* * * * *